US008882645B2

(12) United States Patent
Baptiste

(10) Patent No.: US 8,882,645 B2
(45) Date of Patent: Nov. 11, 2014

(54) PARTIALLY STABILIZED EXERCISE DEVICE MOUNTED WITH ELASTIC RESISTANCE MEMBERS

(76) Inventor: Sandrine Baptiste, Somerset, NJ (US)

( * ) Notice: Subject to any disclaimer, the term of this patent is extended or adjusted under 35 U.S.C. 154(b) by 478 days.

(21) Appl. No.: 13/159,858

(22) Filed: Jun. 14, 2011

(65) Prior Publication Data

US 2011/0306476 A1 Dec. 15, 2011

Related U.S. Application Data

(60) Provisional application No. 61/354,774, filed on Jun. 15, 2010.

(51) Int. Cl.

| | |
|---|---|
| ***A63B 21/02*** | (2006.01) |
| ***A63B 23/02*** | (2006.01) |
| ***A63B 22/18*** | (2006.01) |
| ***A63B 21/055*** | (2006.01) |
| ***A63B 26/00*** | (2006.01) |
| ***A63B 21/00*** | (2006.01) |
| ***A63B 23/035*** | (2006.01) |

(52) U.S. Cl.

CPC ..... *A63B 26/003* (2013.01); *A63B 23/0205* (2013.01); *A63B 21/028* (2013.01); *A63B 2208/0204* (2013.01); *A63B 22/18* (2013.01); *A63B 21/0552* (2013.01); *A63B 21/153* (2013.01); *A63B 23/03516* (2013.01)

USPC ..... 482/121

(58) Field of Classification Search

USPC ..... 482/93, 121–126, 92, 52, 140, 142

See application file for complete search history.

(56) References Cited

U.S. PATENT DOCUMENTS

| | | | | |
|---|---|---|---|---|
| 3,069,162 | A * | 12/1962 | Samuel | 482/110 |
| 4,291,487 | A | 9/1981 | Magid | |
| 5,810,700 | A * | 9/1998 | Orcutt | 482/123 |
| 6,387,022 | B1 | 5/2002 | Smith | |
| 6,652,421 | B1 | 11/2003 | Chen | |
| 6,746,372 | B2 * | 6/2004 | Hsu | 482/34 |
| 6,837,836 | B2 * | 1/2005 | Huang | 482/126 |
| D507,608 | S * | 7/2005 | Chen | D21/662 |
| 7,285,080 | B1 | 10/2007 | Chiu | |
| 7,344,487 | B2 * | 3/2008 | Carter et al. | 482/142 |
| 7,475,442 | B1 | 1/2009 | Dierking et al. | |
| 2005/0107227 | A1 * | 5/2005 | Massey | 482/121 |
| 2005/0143234 | A1 * | 6/2005 | Massey | 482/140 |
| 2006/0264300 | A1 | 11/2006 | Chen | |
| 2007/0225133 | A1 * | 9/2007 | Castro | 482/140 |
| 2009/0029833 | A1 | 1/2009 | Lin | |

FOREIGN PATENT DOCUMENTS

| | | |
|---|---|---|
| JP | 26271909 | 12/2006 |
| WO | WO2006115822 | 11/2006 |
| WO | WO2007027647 | 3/2007 |

* cited by examiner

*Primary Examiner* — Loan H Thanh
*Assistant Examiner* — Megan Anderson
(74) *Attorney, Agent, or Firm* — Gearhart Law, LLC

(57) ABSTRACT

An exercise device for developing strength, balance coordination and flexibility of the arms, legs, back, abdominals and stabilizer muscles of the user. The exercise device includes a large, spherically-shaped, resilient exercise ball having a flat planar base insert with a set of elastic resistance members to perform various resistance training exercises.

11 Claims, 10 Drawing Sheets

PARTIALLY STABILIZED EXERCISE DEVICE MOUNTED WITH ELASTIC RESISTANCE MEMBERS

CLAIM OF PRIORITY

This application claims priority to U.S. Ser. No. 61/354,774 filed on Jun. 15, 2010, the contents of which are fully incorporated herein by reference.

FIELD OF THE INVENTION

The invention relates to a partially stabilized exercise device. More particularly, this invention relates a partially stabilized exercise device based upon an exercise ball wherein the exercise ball may have one truncated end with a recess and a flat planar base insert and a set of elastic resistance members located within the recess.

BACKGROUND OF THE INVENTION

An exercise ball is typically a large, spherical, resilient ball that can be used for a variety of exercises. These balls are also commonly referred to as a "Swiss ball", "Swiss exercise ball", "stability ball" or a "Pilates ball." Exercise balls have been used for a broad range of purposes ranging from therapeutic exercises to uses in exercises intended to develop a user's flexibility, balance and strength, including the strength of the user's stabilizer muscles. Exercise balls are typically used on the surface of a floor, whereby the user may rest a portion of their body upon the ball, thereby adding an element of instability during the exercise between the user and the floor. This instability would not normally be experienced by a user with the associated exercise in the absence of the ball. The main cause of this instability is that the ball is not secured in any manner, other than by the weight of the user. Consequently, the ball is free to travel in any two dimensional direction by means of rotation across the horizontal plane created by the underlying floor. Thus the typical exercise ball tends to roll away easily. Thus, the user is very likely to accidentally slip off the ball during use thereby increasing the probability of injury to the user.

The inherent characteristics of exercise balls have led to the recognition of numerous therapeutic uses for them. Due in part to these uses and characteristics, exercise balls have been incorporated into a number of exercise devices and other articles.

DESCRIPTION OF THE RELATED ART

The relevant prior art involving exercise devices includes:

U.S. Pat. No. 6,702,726 to Lin discloses a compliant body-pressing exerciser is adapted to be detachably coupled to a seat frame, and includes a bowl-shaped lower member and a dome-shaped upper member formed respectively with upper and lower surrounding edge portions that engage each other and adapted to contact the ground and compliantly press against a user's body. A height of the upper member is larger than that of the lower member. A shortest one of radial distances measured from a central point to the lower surrounding edge portion is not less than the height of the upper member so as to lower the gravity center of the exerciser.

U.S. Pat. No. 6,719,676 to Hsu discloses an inflatable elastic exercising device includes a deflatable collapsible elastic body and a base seat composed of assembled outer frames and reinforcing boards. The elastic body is formed with a fixing flange. The thickness of the fixing flange plus the thickness of the reinforcing board is just the height of a restricting channel of the outer frame, so that the reinforcing boards and the elastic body can be firmly fixed and enclosed by the outer frames. A user can stably and safely stand on it for doing balance exercise. After the elastic body is deflated and collapsed and the reinforcing boards and the outer frames are disassembled and stacked, it can be stored in a narrow space and conveniently transported.

U.S. Pat. No. 6,740,008 to Ho discloses a multipurpose exercising apparatus is constructed to include a plastic flat base frame positionable on a flat surface, the base frame having a plurality of eyes spaced around the periphery thereof, a semispherical shell made from polyurethane and covered on the base frame, the semispherical shell having a plurality of raised portions over the outer surface thereof for imparting a massaging effect to the user using the multipurpose exercising apparatus, and a plurality of elastic pull cords selectively fastened to the eyes of the base frame for pulling by the user.

U.S. Patent Application Publication No. 2005/0107229 to Wickens discloses a stability ball is disclosed that includes an inflatable bladder with filler such as sand disposed therein. The amount of sand is selected to stabilize the stability ball with respect to a support surface, thereby preventing the stability ball from moving on a flat surface when the stability ball is not being utilized by the user. The amount of filler is sufficiently small that the user is substantially unaffected by the extra weight when performing core body exercises.

U.S. Patent Application Publication No. 2009/0029833 to Lin discloses an exercising ball includes an inflatable ball body made of an elastic material and defining a chamber, and a moving element disposed movably in the chamber. The inflatable ball body has a passage hole that permits the moving element to enter the chamber, and an inflation valve fitted sealingly and removably in the passage hole.

U.S. Pat. No. 7,004,886 to Chen discloses an air cushion for exercise in accordance with the present invention has a bladder and a ballast stay accommodated inside the bladder. The bladder has a flat bottom and a bulge top. The ballast stay is thermally welded to the bottom to stiffen the bottom to make the air cushion stably placed on the ground. Combining the bladder and ballast stay in one piece makes the configuration of the air cushion simple and also simplifies the manufacturing process to reduce product cost of the air cushion.

U.S. Patent Application Publication No. 2004/0220030 to Chu discloses an exerciser includes a base including a top and a semispherical member including a semispherical periphery having a lower end. The lower end of the semispherical periphery of the semispherical member includes an engaging portion for engaging with the top of the base. The semispherical member further includes a bottom side that does not extend beyond a plane on which the lower end of the semispherical periphery of the semispherical member lies.

U.S. Pat. No. 6,945,919 to Yang discloses a balance-exercising semi-spherical apparatus has an annular frame and a fixing ring sequentially fixed on a base disk; the base disk is connected on two diametrically mutually opposite ends thereof with two movable pulling ropes, and has thereon a hole for connecting an external aeration equipment. The annular frame is in the form of a semi-sphere with an air cushion therewithin, the air cushion connects an air faucet; the air faucet is used to aerate the air cushion to form a semi-sphere through the external aeration equipment. Thereby, a user can hold the pulling ropes on the two diametrically mutually opposite ends of the base disk with hands to tread, jump, seat and lie on the air cushion for exercising for health and balance exercising.

U.S. Pat. No. 6,746,372 to Hsu discloses an exercising ball holder for fixing an exercising ball and locking elastic cords includes a base seat, multiple extension arms and at least one elastic cord. The base seat is formed with a rest depression. A lower end of the exercising ball is rested and located in the depression without easily rolling out. The multiple extension arms respectively outward horizontally extend from the base seat. Each extension arm has a fixing loop section. The elastic cord has a hook section and has a handle. It can ensure safety in use of the exercising ball. The position of the elastic cords can be quickly changed to achieve various exercising effects.

U.S. Pat. No. 5,810,700 to Orcutt discloses an exercise apparatus includes a resilient ball, a flexible strap assembly, and a resistance member coupled to the resilient ball via the flexible strap assembly. The resilient ball is configured such that a user rests a portion of his or her body on the resilient ball while pulling the resistance member in an elongation direction. The strap assembly includes first and second straps adapted to surround and couple to the resilient ball. A loop formed from one of the straps receives the resistance member.

U.S. Pat. No. 6,309,331 to Raymond discloses an abdominal exerciser device comprising a resilient rubber ball rollably engaging a plurality of ball bearings mounted inside an almost complete in height semi-spherical cavity upwardly oriented within a self-standing casing and allowing the rubber ball a free-rolling action when applied against a body part such as the abdominal, waist and/or hips effectively pressuring and massaging the muscles of the body part. One or more casings may also be mounted on absorbing materials themselves mounted onto a rigid frame structure adapted to support a user.

Other patents disclosing chairs or exercise devices incorporating exercise ball-like objects, or variations thereof, include U.S. Pat. No. 6,575,885 to Weck, U.S. Patent Application Publication No. 2004/0180768 to Almada, U.S. Patent Application Publication No. 2006/0264300 to Chen, U.S. Pat. No. 6,387,022 to Smith, U.S. Pat. No. 6,652,421 to Chen, U.S. Pat. No. 7,285,080 to Chiu, U.S. Pat. No. 4,291,487 to Magid, U.S. Pat. No. 4,126,326 to Phillips, U.S. Pat. No. 5,690,389 to Ekman et al., U.S. Pat. No. 5,833,587 to Strong et al., U.S. Pat. No. 6,461,284 B1 to Francavilla, and U.S. Pat. No. 6,478,721 to Hunter.

As discussed above, exercise balls are useful tools for exercise, but suffer from a number of limitations as a result of their ability to roll in any direction along the horizontal plane thus causing them to be inherently unstable. This instability often makes it more difficult to isolate the desired muscle group or groups intended by a particular exercise motion. The feeling of instability can be unnerving to inexperienced users and may even lead to injury due to loss of balance or when otherwise used improperly. Since the exercise ball is not secured by any means, it is difficult to firmly stabilize an isolated part of the user's body, such as the user's feet or hands, so as to apply a significant amount of force to be exerted during the motion of the exercise. Thus, this instability may not always be desired by the user.

It is noted that attempts to solve the instability problem associated with stability balls include the addition of solid base elements to the stability ball. However, most of the solid base elements utilized prior to the present invention both limit the rolling of the ball, as well as, prevent the user from using the exercise device as a free ball. Many important core body exercises require the stability ball to roll in at least one direction. In some instances, a stability ball with a base may also be too heavy for a user to perform desired exercises. In addition, the use of a separate solid base element for use with an exercise ball also increases manufacturing costs.

Thus, what is needed is an exercise device that overcomes the limitations associated with stability balls as discussed above.

SUMMARY OF THE INVENTION

The invention relates to a partially stabilized exercise device.

Marked

In a preferred embodiment, the partially stabilized exercise device may be a truncated sphere having a diameter in a range of approximately 40 to 80 centimeters. The partially stabilized exercise device may be constructed of a suitably soft, but resilient material so as to be deformable within a range of 1 to 15 percent under the weight of an average sized adult human. In a preferred embodiment, the partially stabilized exercise device (10) may have truncation diameter that is less than or equal to half the diameter of the sphere.

The partially stabilized exercise device may have a substantially planar insert located within a recess within the truncated end of the sphere.

There may also be one or more elastic resistance members located within the recess. The elastic resistance members may, for instance, be attached to the truncated sphere at three or more spatially separated points. In a preferred embodiment, the elastic resistance member may extend along substantially the entire inner perimeter of the recess.

In a further embodiment of the present invention, the partially stabilized exercise device may include a large inflatable spherically shaped resilient ball having detachable elastic resistance members and a flat planar base insert. The device may, for instance, include a coupling assembly for coupling the resistance members to flat planar base insert or to the spherical ball. The flat planar base insert may have a horizontal diameter that is less than half the length of the total diameter of the large inflatable spherically-shaped ball.

In certain embodiments the partially stabilized exercise device may include a flat planar base insert to facilitate placement of the device on a flat planar surface such as a floor. The flat planar insert may include at one or more sets of elastic resistance members that may be mounted to the frame of the insert by a coupling assembly. The elastic resistance member may be designed to be grasped by a user. The flat planar insert may also be used as a footrest adapted to secure a user's foot while performing exercises using the elastic resistance members contained therein.

Therefore, the present invention succeeds in conferring the following, and other not mentioned, desirable and useful benefits and objectives.

It is the primary objective of the present invention to provide a low cost solution for stabilizing an exercise ball with respect to a support surface, without compromising the benefits that the instability ball provides to its users.

It is an objective of the present invention that numerous exercises are possible to the user depending upon how the exercise device is configured with respect to location and use of the flat planar insert, whether as a footrest or means to secure the exercise ball in a stationary location. In use, the user may rest a portion of their body weight on the ball and exert an applied force to rotate the ball. Alternatively the user could "secure" the ball in a stationary position to facilitate additional exercises.

It is a further objective of the present invention to provide an exercise device having a planar base insert containing elastic resistance members which can be used to perform various resistance exercises.

It is a further objective of the present invention to provide an exercise device having a planar base insert to stabilize the large spherically shaped resilient ball while in use.

It is a further objective of the present invention to provide the above exercise device in which the position of the elastic members are detachable and can be quickly changed so as to achieve various exercising effects.

It is a further objective of the present invention to provide the above exercise device in which the elastic resistance members are adjustable in position, length and resistance so as to achieve various exercising effects.

It is an objective of the present invention to provide a high freedom degree of usage while concurrently providing a high level of safety which are unprecedented with respect to the conventional exercise devices in the prior art.

It is an object of the present invention for the exercise device to be throwable without causing damage to the exercise device itself or the surrounding walls or floors while in use.

It is an objective of the present invention to provide a rehabilitation effect to a user's muscles.

It is an objective of the present invention to serve as a health maintenance and improvement device for the user.

It is still a further objective of the present invention to provide the above exercise device having a simple structure and which can be manufactured at a low cost.

For a fuller understanding of the invention, reference should be made to the accompanying drawings, taken in connection with the following detailed description, in which:

DESCRIPTION OF THE PREFERRED EMBODIMENTS

Figure 1A:
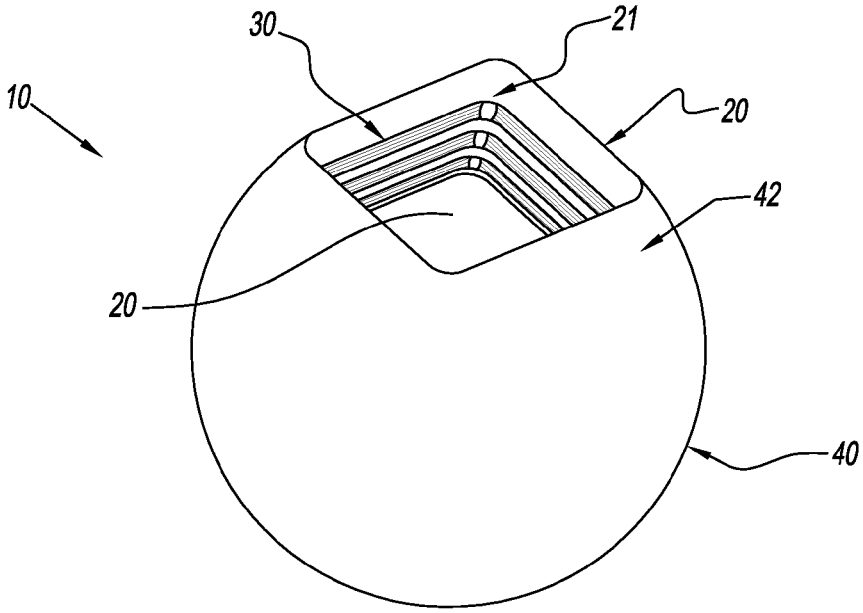
FIG. 1A is a perspective view of the embodiment of the invention showing the partially stabilized exercise device partially cut-away to illustrate the flat planar base insert comprising a set of variable elastic resistance members, the elastic resistance members being affixed to the frame of the flat planar base insert via a coupling assembly, the flat planar base insert being incorporated into a large, spherically-shaped, resilient ball.
Figure 1B:
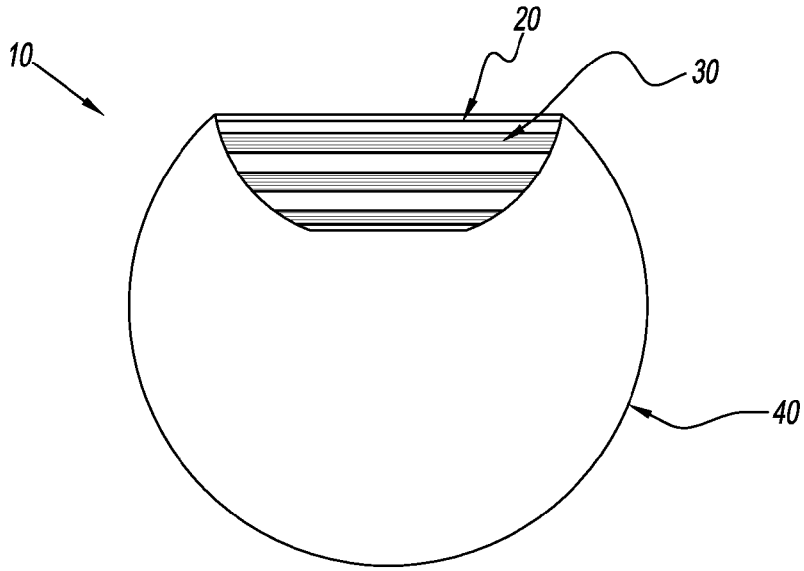
FIG. 1B is a side view of the embodiment of the invention depicted in FIG. 1A showing the partially stabilized exercise device being partially cut-away to illustrate a flat planar base insert having a set of variable elastic resistance members; the flat planar base insert being incorporated in to a large, spherically-shaped, resilient ball.

The preferred embodiments of the present invention will now be described with reference to the drawings. Identical elements in the various figures are identified with the same reference numerals.

The present invention relates generally to a partially stabilized exercise device. In one embodiment, the partially stabilized exercise device is stabilized with respect to a support surface via a flat planar base insert. By being stabilized with respect to the support surface, rolling/rotation along the support surface is minimized.

In a preferred embodiment, the partially stabilized exercise device (10) may be a truncated sphere having a diameter in a range of approximately 40 to 80 centimeters. The partially stabilized exercise device (10) may be constructed of a suitably soft, but resilient material so as to be deformable within a range of 1 to 15 percent under the weight of an average sized adult human. In a preferred embodiment, the partially stabilized exercise device (10) may have truncation diameter that is less than or equal to half the diameter of the sphere.

The partially stabilized exercise device may have a substantially planar insert (20) located within a recess within the truncated end (42) of the sphere.

There may also be one or more elastic resistance members located within the recess. The elastic resistance members (30) may, for instance, be attached to the truncated sphere at three or more spatially separated points. In a preferred embodiment, the elastic resistance member (30) may extend along substantially the entire inner perimeter of the recess.

In a further embodiment of the present invention, the partially stabilized exercise device (10) may include a large inflatable spherically shaped resilient ball having detachable elastic resistance members (30) and a flat planar base insert. The device may, for instance, include a coupling assembly (21) for coupling the resistance members (30) to flat planar base insert (20) or to the spherical ball (40). The flat planar base insert (20) may have a horizontal diameter that is less than half the length of the total diameter of the large inflatable spherically-shaped ball.

In various embodiments, the exercise device (10) of the present invention typically includes a large spherically shaped resilient ball (40), elastic resistance members (30), a flat planar base insert (20), a coupling assembly (21) for coupling resistance members (30) to flat planar base insert (20). Exercise device (10) is configured to allow user (50) to rest a portion of his or her body on the large spherically shaped resilient ball (40) or the flat planar base insert (20) while pulling resistance members (30) in an elongation direction toward the user's body.

As shown in FIGS. 1A, 1B, 2A and 2B, preferred embodiments of the partially stabilized exercise device (10) have a flat planar base insert (20) comprising a set of variable elastic resistance members (30), the elastic resistance members (30) being affixed to the frame of the flat planar base (20) insert via a coupling assembly (21), the flat planar base insert (20) being incorporated in to a large, spherically-shaped, resilient ball (40).

In a preferred embodiment, the partially stable exercise device (10) comprises a large, spherically-shaped, resilient ball (40) having a flat planar base insert (20) comprising at least one set of elastic resistance members (30) which may be detachably fastened to the flat planar insert for pulling by the user (50) to perform various resistance training exercises. The large, spherically-shaped, resilient ball (40) is adapted to support the weight of a user (50) while the user (50) performs exercises. The partially stable exercise device of the present invention advantageously provides a stability ball that is unstable with respect to a user but stabilized with respect to a surface. The partial stability of the exercise device with respect to the surface allows a user to place the exercise device at a desired location without the ball moving or rolling away but still have the advantages of providing an instability with respect to the user such that the user concurrently derives the benefit of exercising their stability muscles while the device itself is fixed in a stable position. An unstable training environment provides strength training allowing the user to enhances athletic performance by developing stability, balance through development of core and extremity muscles. It is contemplated that use of the exercise device of the present invention requires trunk and extremity muscles to work in both concentric (muscle shortening for force generation) and eccentric (muscle lengthening for force generation) activation patterns. The device of the present invention is dynamic in its use thereby providing an element of movement to stabilization and balance exercises. The exercise device of the present invention can be used to provide a total body workout to the user that is adjustable to the user's level of fitness. Therefore, it is contemplated that the present invention may be used by personal fitness trainers, as well as individual users, to provide a useful unstable environment for exercise purposes.

It is further contemplated that by placing the partially stable exercise device in such a manner whereby the flat planar base insert (20) incorporated into the large spherically shaped resilient ball (40) rests on a stable surface, such as a floor, will prevent all rotation of the exercise device thus allowing the ball to rest in a stationary position. The flat planar base insert (20) embedded at the bottom of the large spherically shaped resilient ball (40) keeps the bottom of the exercise device stable by preventing the exercise ball from rolling away from the user (50). Therefore, the exercise device (10) is stable when the bottom of the flat planar base insert abuts the ground.

However, the exercise device is inherently less stable when the flat planar base insert (20) is inverted or positioned in such a manner that the flat planar base insert (20) does not directly contact the ground thus allowing the user to use the device to perform various exercises to work the user's stabilizing muscles. It is contemplated that the flat planar base insert is incorporated into the large spherically shaped resilient ball (40) ball of the present invention such that the exercise device of the present invention is of one cohesive piece. It is also contemplated that the flat planar base insert is incorporated into the large spherically shaped resilient ball (40) in such a manner that the foot or feet of the user may be secured to the device. It is also contemplated that the flat planar base insert be incorporated with a strap (60) that may, for instance, be made of a hook and loop fastener such as VELCRO™. The strap (60) may be used by the user to secure his or her feet to the exercise device.

Figure 2A:
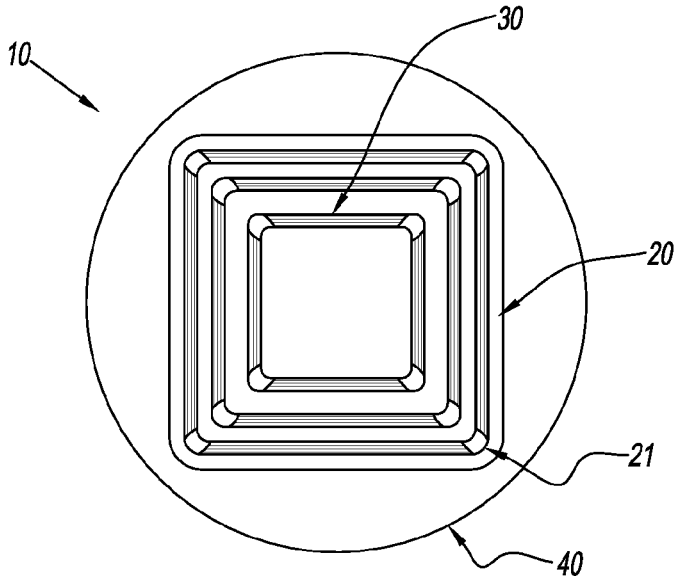
FIG. 2A is an illustration of a top plan view of one embodiment of the partially stabilized exercise device depicted in FIG. 1A showing a flat planar base insert having a set of variable elastic resistance members to perform various resistance training exercises, the elastic resistance members being affixed to the frame of the flat planar base insert via a coupling assembly.
Figure 2B:
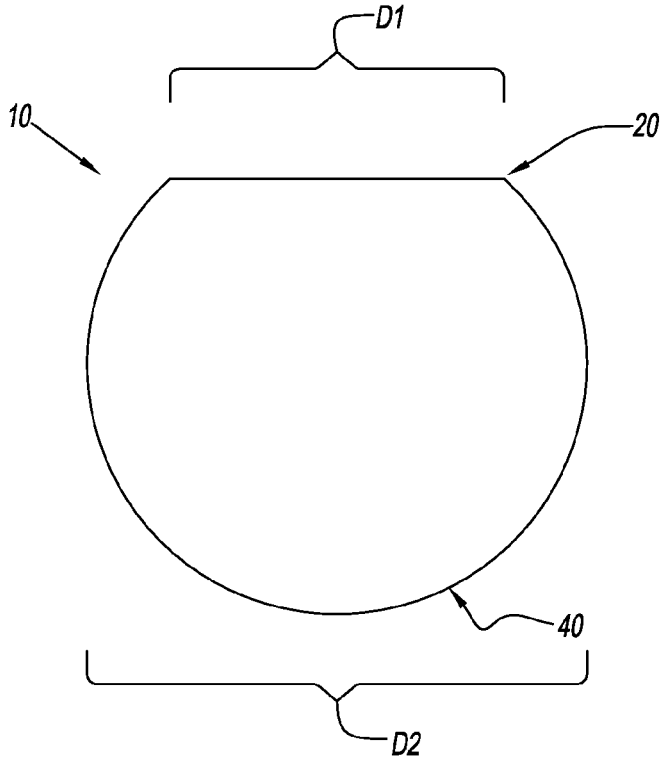
FIG. 2B is a side perspective view of one embodiment of the partially stabilized exercise device of the present invention.
Figure 3A:
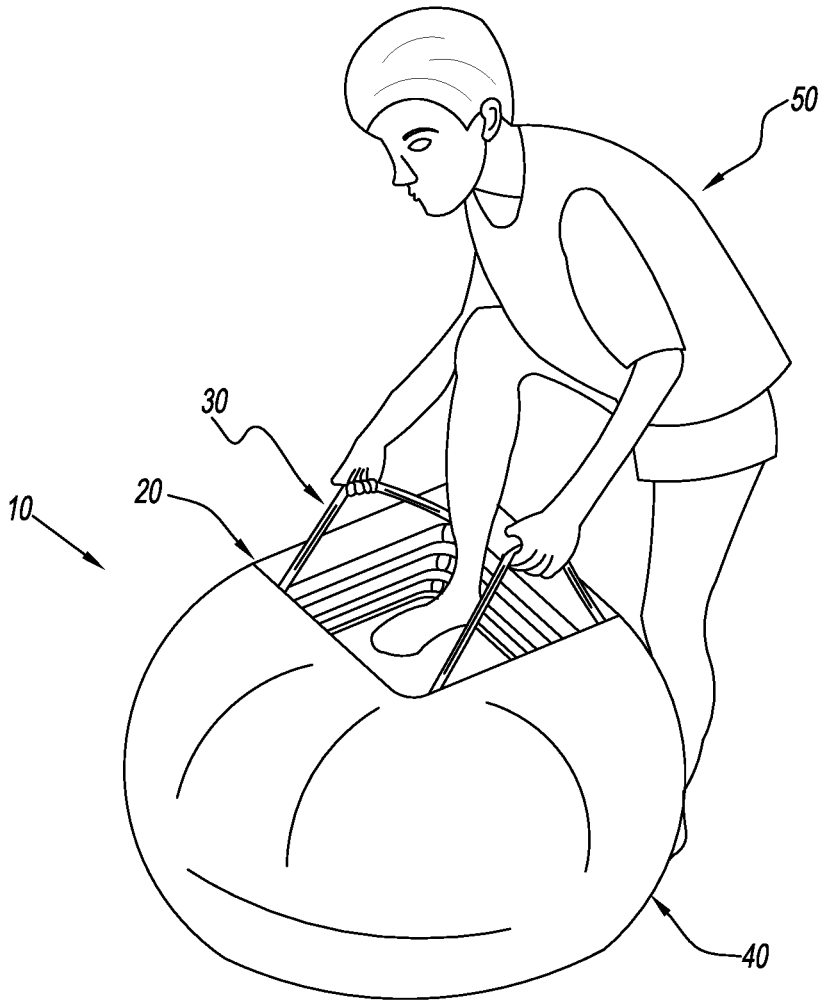
FIG. 3A is a perspective view illustrating the use of one embodiment of the partially stabilized exercise device as shown in FIG. 1A in performing a resistance exercise by a user where the user is depicted holding a set of variable elastic resistance members while having one foot securely placed on the floor and the other foot securely placed with bended knee on the flat planar base insert of the exercise device.

In order to prevent the partially stable exercise device (10) from easily rolling away from the user while performing exercises, the horizontal diameter D1 of the flat planar base insert (20) as shown in FIG. 2B is less than the length of the total diameter D2 of the large, spherically-shaped, resilient ball (40). Thus, in a preferred embodiment, the diameter D1 of the flat planar base insert (20) is less than 60 cm when the total diameter D2 of the large, spherically-shaped, resilient ball (40) is in a range of 45 to 75 cm. For example, assuming that the total diameter D2 of the large, spherically-shaped, resilient ball (40) of the exercise device (10) of the present invention is 60 cm then the diameter D1 of the flat planar base insert (20) is less than 30 cm; thus allowing the lower end of the exercising device (10) to be partially stabilized preventing it from randomly rolling in any direction. The flat planar base insert (20) of the present invention may also be used by user (50) as a footrest while performing various exercises as illustrated in FIG. 3A or as a platform to stand thereon to do balance exercise. The balance exercise can therefore be performed safely with a stable footing. In a preferred embodiment, the depth of the flat planar base insert (20) is between 5 cm and 16 cm.

In order for the exercise device (10) to roll while in use, the rotational force applied by the user (50) to the exercise device (10) must be greater than the rotational resistance created by the flat planar base insert (20) when the flat planar base insert (20) is abutted against the ground. By resisting rotation of the ball, the flat planar base insert (20) of the present invention minimizes the unexpected movement of the exercise device (10) while in use in relation to the position of the user (50).

The total diameter of the large spherically shaped resilient ball (40) is generally in a range of 45 to 75 cm. In a preferred embodiment, the large spherically shaped resilient ball (40) is inflatable to an approximate size of 45 cm. to 75 cm. in total diameter. The large spherically shaped resilient ball (40) of the exercise device (10) can be smooth or it can have a textured surface to minimize slippage between the user and the exercise device (10) or alternatively between the exercise device (10) and the floor.

Large spherically shaped resilient ball (40) is adapted to support user (50) while he or she performs exercises upon exercise device (10). Exercise device (10) may be formed from a soft, strong, and durable material such as nylon, polyurethane, rubber, polyvinyl chloride or the like. In a preferred embodiment, the large spherically shaped resilient ball (40) is hollow and may be inflated to a desirable gas or fluid pressure to lend a resilient property to exercise device (10). The specific size, shape, and composition of exercise device (10) may vary to suit the specific application and/or to meet the specific needs of user (50). The materials used for the present invention should be aesthetically pleasing to the user.

In certain embodiments where the large spherically shaped resilient ball (40) is inflatable, it is constructed from a puncture-resistant material which, when punctured, deflates slowly for safety reasons. The materials to be used in the construction of the large spherically shaped resilient ball (40) will be apparent to a person of ordinary skill in the art. Alternatively, the large spherically shaped resilient ball (40) can be solid, non-inflatable and constructed of a solid material such as foam rubber or comparable materials which will be apparent to a person of ordinary skill in the art.

In a preferred embodiment, the large, spherically-shaped, resilient ball (40) of the present invention is inflatable and made of a vinyl, rubber or plastic material. In another embodiment, the large, spherically-shaped, resilient ball (40) may be non-inflatable and made of a solid material such as foam rubber. It is contemplated that a preferred embodiment, the large, spherically-shaped, resilient ball (40) may be fabricated by a thin, gas impervious, flexible and resilient transparent sheet material such as PVC film which is suitable for fabrication into a closed surface by high frequency heat sealing or by adhesives in a manner conventionally well-known in the trade.

The large, spherically-shaped, resilient ball (40) has a rounded wall that is adapted to permit a user to sit or to lie down, and to press, roll, shake, or throw the exercise ball. In another embodiment, the large, spherically-shaped, resilient ball (40) further has a tubular protrusion that extends into the chamber from the rounded wall and that defines a passage hole, and an inflation valve for filling the vessel with a suitable gas or liquid.

To keep the weight of the exercise device (10) at a minimum, the inflatable large, spherically-shaped, resilient ball (40) is made from a thin, lightweight and sturdy material such as polyvinyl chloride. In one embodiment, the inflatable large, spherically-shaped, resilient ball (40) is formed from a burst resistant material such as a material comprising primarily polyvinyl chloride in combination with other materials, compounds, or the like. Generally the lighter and stronger the material, the more suitable the material is for forming the inflatable large, spherically-shaped, resilient ball (40). To be suitable for exercising thereon, the inflatable large, spherically-shaped, resilient ball (40) resists bursting under pressures exerted by a user thereon. Example burst weights include weights from 200 to 1000 lbs. A person of skill in the art will recognize that the inflatable large, spherically-shaped, resilient ball (40) can be formed from any one of a number of materials.

Referring again to FIGS. 1A, 1B, 2A and 3A, the exercise device (10) includes a flat planar base insert (20) having one or more elastic resistance members (30) affixed to the frame of the flat planar base insert (20) via a coupling assembly (21). In a preferred embodiment, the coupling assembly (21) may be a plurality of detachably connected hooks and loops respectively formed on the frame of the flat planar base insert (20) and ends of the elastic resistance members (30). The elastic resistance members (30) affixed to the frame of the flat planar base insert (20) provide resistance in response to the applied force of a user (50). For example, resistance members (30) constructed of a resilient material could be affixed to the frame of the flat planar base insert (20) to allow a user to perform various extension and contraction exercises, such as bicep curls or triceps extensions, while having a foot positioned on the planar base insert (20) of the exercise device (10). The elastic resistance members (30) can be affixed to the frame of the planar base insert (20) at numerous locations. The elastic resistance members (30) can include a handle adapted to be grasped by hands of a user (50). In such a configuration a user would be able to perform exercises such as arm curls on the exercise device (10) by grasping the elastic resistance members (30) and placing his legs atop the flat planar base insert (20). The arm curls can then be performed by pulling the elastic resistance members (30) toward the user's body.

As shown in FIG. 3A, one embodiment of the partially stabilized exercise device (10) as shown in FIG. 1A can be used in performing a resistance exercise by a user (50) where the user (50) is depicted holding a set of variable elastic resistance members (30) while having one foot securely placed on the floor and the other foot securely placed with bended knee on the flat planar base insert (20) of the partially stabilized exercise device (10). Referring to FIG. 3A, the user (50) is using the flat planar base insert (20) as a footrest while the user (50) is performing a resistance exercise where the user (50) is depicted holding the elastic resistance members (30) with one foot securely placed on the floor and the other foot securely placed with bended knee on the flat planar base insert (20) of the exercise device (10). From this position, the user will exert force with the muscles of the arms, legs, and torso causing an extension of the user's legs and reducing the flexion of the user's knees. As the user performs this motion, the large spherically shaped resilient ball (40) will deform slightly thus providing an instability which will activate and work the stabilizing muscles of the user's legs and exercises his or her core muscles to maintain balance during the exercise routine.

Figure 3B:
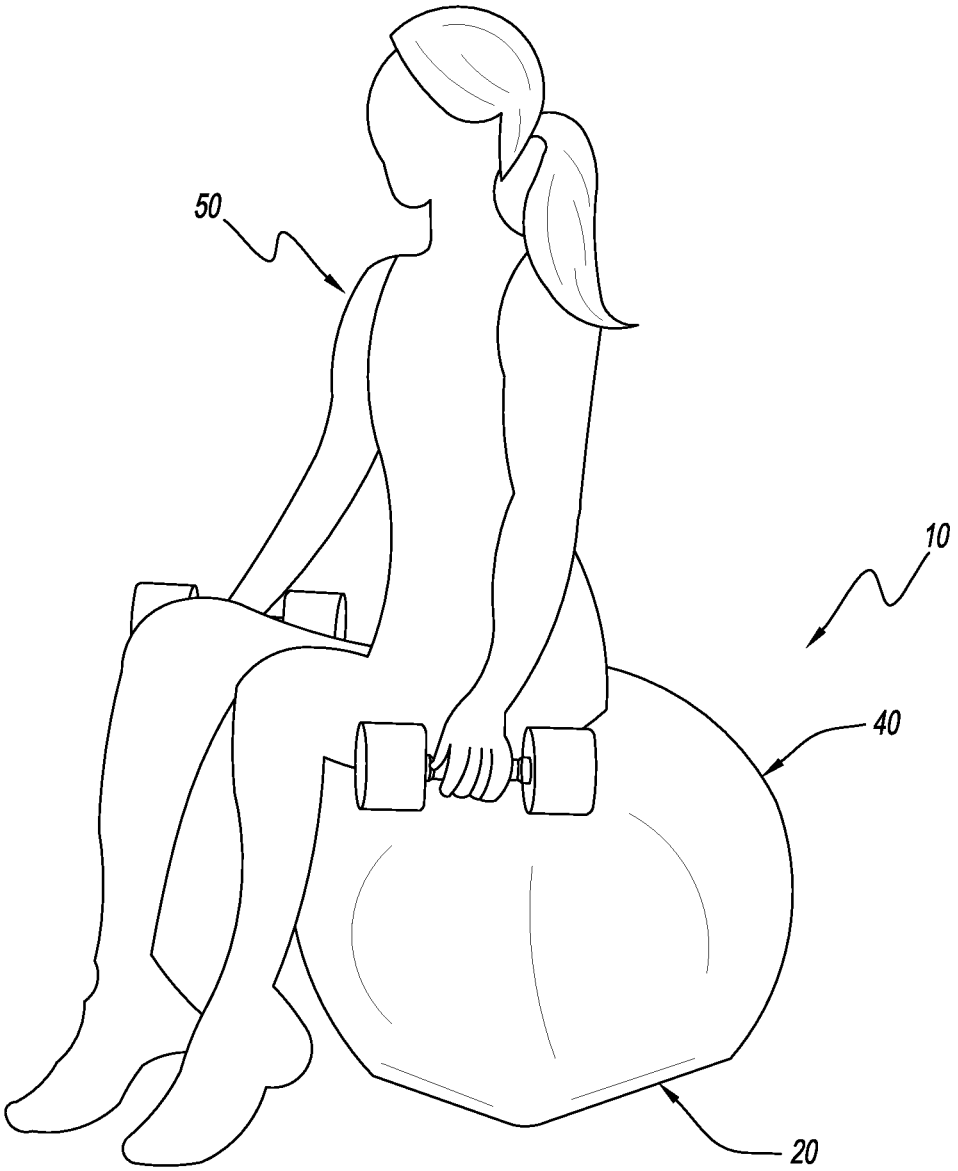
FIG. 3B is a perspective view illustrating the use of one embodiment of the partially stabilized exercise device as shown in FIG. 1A in performing a resistance exercise by a user where the user is depicted sitting on the large spherically shaped resilient ball holding a set of free standing dumbbell weights with both feet securely placed on the floor with the flat planar base insert of the partially stabilized exercise device being placed against the floor to secure the partially stabilized exercise device in a stationary position.

Referring to FIG. 3B, one embodiment of the partially stabilized exercise device (10) can be used in performing a resistance exercise by a user where the user (50) is depicted sitting on the large spherically shaped resilient ball (40) holding a set of free standing dumbbell weights with both feet securely placed on the floor with the flat planar base insert (20) of the partially stabilized exercise device being placed against the floor to secure the partially stabilized exercise device in a stationary position.

Figure 3C:
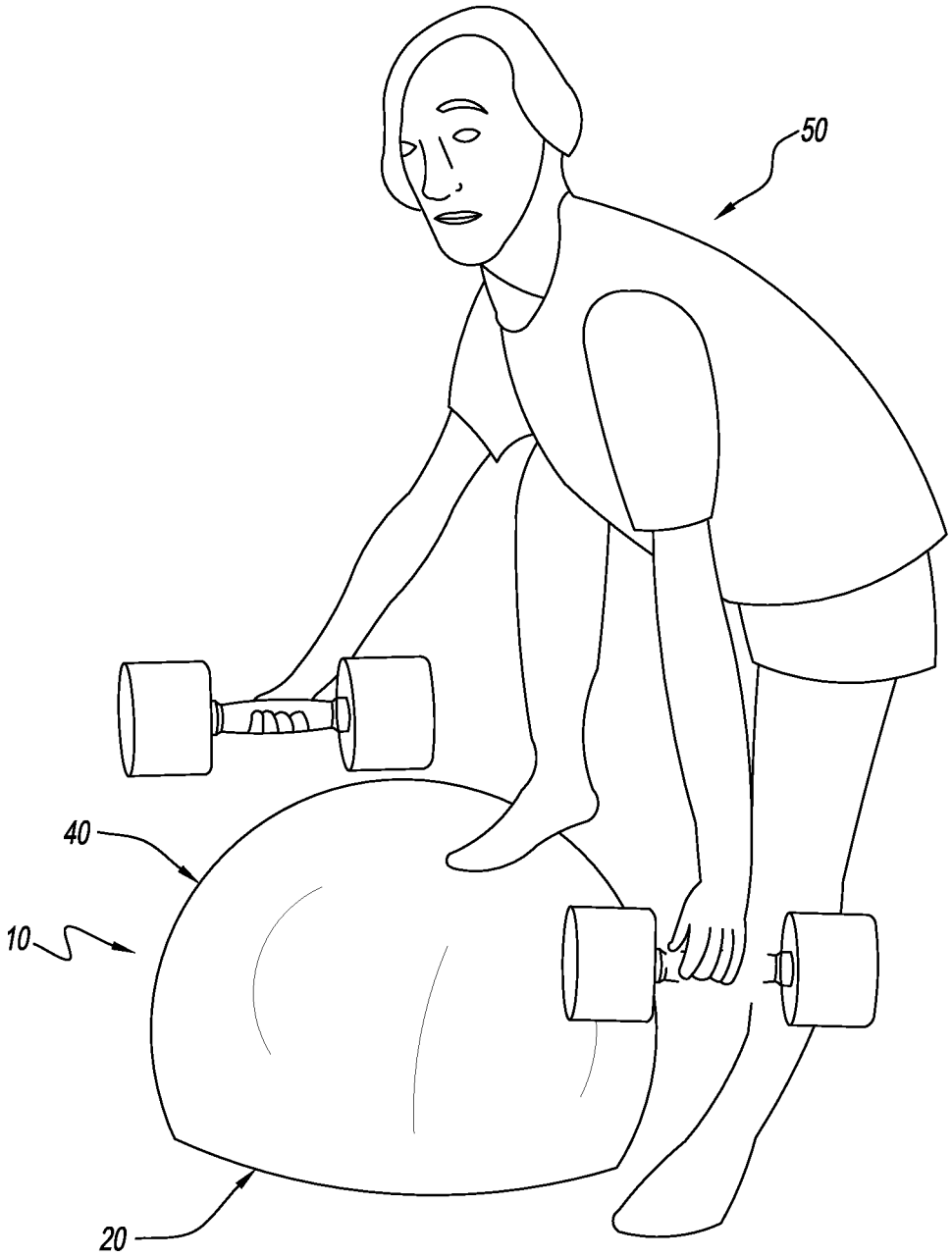
FIG. 3C is a perspective view illustrating the use of one embodiment of the partially stabilized exercise device as shown in FIG. 1A in performing a resistance exercise by a user where the user is depicted holding a set of free standing dumbbell weights with one foot securely placed on the floor and the other foot securely placed with bended knee on the rounded portion of the exercise ball with the flat planar base insert of the partially stabilized exercise device being placed against the floor to secure the ball in a stationary position.

FIG. 3C illustrates the use of one embodiment of the partially stabilized exercise device (10) as shown in FIG. 1A in performing a resistance exercise by a user (50) where the user (50) is depicted holding a set of free standing dumbbell weights with one foot securely placed on the floor and the other foot securely placed with bended knee on the rounded portion of the large spherically shaped resilient ball (40) with the flat planar base insert (20) of the exercise device (10) being placed against the floor to secure the ball in a stationary position. The user can rest his foot on the flat planar base insert (20) while exercising with hand weights. The instability caused by the slight deformation in the large spherically shaped resilient ball (40) requires the user (50) to flex and exert core body muscles to maintain balance while performing the hand weight exercise. Instead of simply exercising a targeted group of muscles, use of the exercise device (10) allows the user (50) to exercise core or stabilizing muscles.

It should be apparent from the foregoing that a multitude of other exercises are possible with the exercise device (10) of the present invention. Although FIGS. 3A and 3B show a user (50) performing a specific exercise, nothing limits the use of exercise device (10) to any particular exercise. Indeed, exercise device (10) is preferably configured to enable user (50) to conveniently perform a number of different exercise movements to train a variety of muscle groups. The shape, size, and other physical characteristics of exercise device (10) may vary, for example to suit the needs of the specific application, user, or production limitations. It is contemplated that the exercise device of the present invention may be utilize in a number of body positions by the user, including but not limited to, standing position (standing on both legs on the ground or with one leg on the ground), laying down on the floor, sitting on a floor, or the user being in a prone or supine position.

Exercise device (10) is preferably largely spherical having a flat planar base insert (20) on one portion of the ball wherein the flat planar base insert (20) represents a deformed state allowing the exercise device (10) to remain in a stationary position when the flat planar base insert is rest against the ground.

The exercise device (10) of the present invention can also have a non-spherical shape. Non-spherical shapes include various shapes such as elliptical, egg-shaped, and bi-lobed. The exercise device (10) of the present invention can be any shape that has some degree of curvature such that a user will be destabilized when positioned thereon. The curvature also causes instability of the ball with respect to the support surface.

Elastic resistance member (30) is configured to provide resistance in response to a force applied by user (50). The elastic resistance member(s) (30) are removable, and may be easily released or locked to the planar base insert, and interchangeable to facilitate different exercises. It is contemplated that the elastic resistance members (30) may be of different lengths.

In the preferred embodiment, elastic resistance member (30) is formed from a length of rubber or polyurethane strips or tubing. Alternatively, elastic resistance member (30) may be formed from a plurality of elastic bands, a sheet of elastic ribbon, or any suitable material for generating resistance. The resistance of elastic resistance member (30) may be selected according to several factors, such as the thickness of a resistance material or a particular composition of an elastomeric material. In addition, it is contemplated that the elastic resistance member may vary in the length and effective tension.

Further, in a preferred embodiment of the invention, the exercise device (10) may have more than one elastic resistance member (30), either singly or in combination, to facilitate variations of resistances or exercises. A coupling assembly (21) comprises any suitable mechanism for connecting elastic resistance member (30) to the flat planar insert (20). The exercise device (10) may incorporate two or more separate resistance members (30) coupled to flat planar base insert (20) in any number of locations. The specific locations of such resistance members (30) may be selected to suit the needs of individual users and/or to accommodate specific exercise movements. For example, coupling assembly (21) may be configured to include multiple connect points for one or more resistance members.

The elastic resistance members (30) may include a handle adapted to be grasped by the hand of a user. It is contemplated that the elastic bands offer a varying amount of resistance to the user. It is further contemplated that the elastic resistance members (30) can be interchanged based upon the user's strength. It is further contemplated that the elastic resistance members (30) can be used for various exercises such as curls. In a preferred embodiment the elastic resistance members will be composed of a rubber or polyurethane material. Other suitable materials to construct the elastic resistance members (30) will be apparent to a person of ordinary skill in the art.

Figure 4:
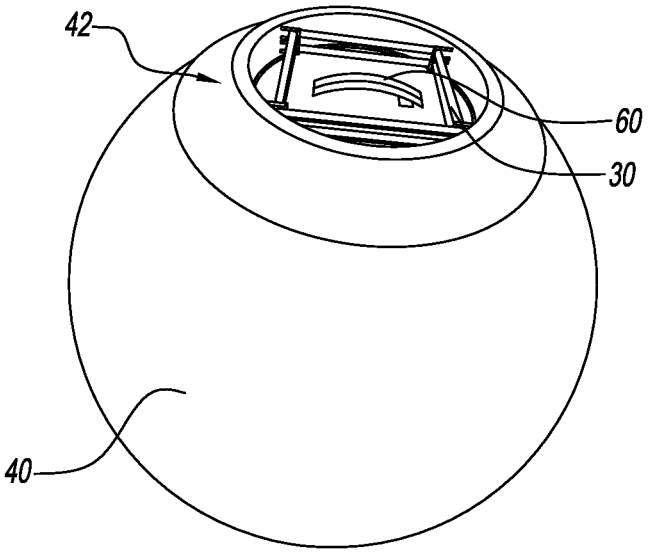
FIG. 4 is a perspective view of a further embodiment of the present invention.

FIG. 4 is a perspective view of a further embodiment of the present invention. The partially stabilized exercise device (10) of this embodiment may have a strap (60) and the elastic resistance members (30) may be connected to the truncated end (42) of the sphere by means of hooks (70).

Figure 5:
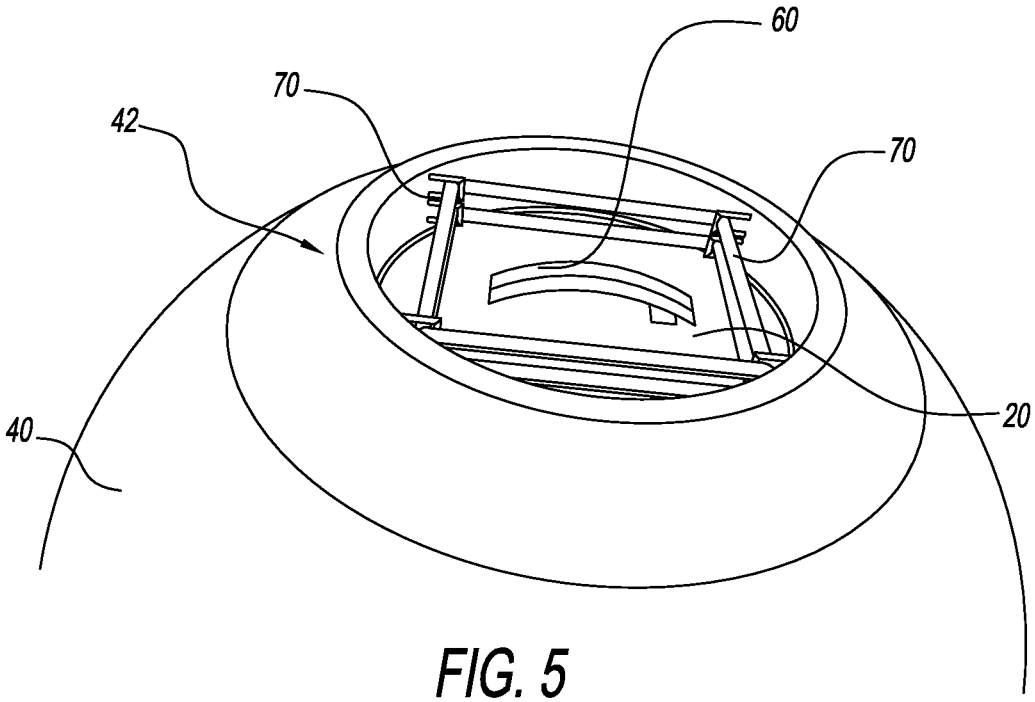
FIG. 5 is a close up perspective view of the embodiment of the present invention shown in FIG. 4.

FIG. 5 is a close up perspective view of the embodiment of the present invention shown in FIG. 4. In FIG. 5 the strap (60) and the hooks (70) are shown in more detail. The strap (60) may, for instance, include a hook and loop attachment such as, but not limited to, the material sold under the trade name of VELCRO™. In addition to serving as a handle for carrying the partially stabilized exercise device (10), the strap (60) may also be used to secure a user's (50) foot during exercise.

Figure 6A:
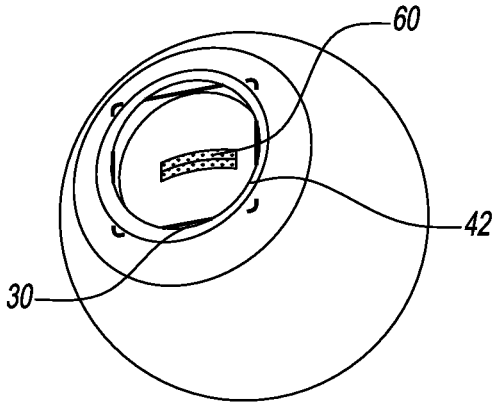
FIG. 6A is a perspective view of yet a further embodiment of the present invention.

FIG. 6A is a perspective view of yet a further embodiment of the present invention.

In this embodiment of the partially stabilized exercise device (10), the elastic resistance members (30) is attached to the truncated end (42) of the sphere by means of being threaded through holes in the side of the truncated end (42) of the sphere.

Figure 6B:
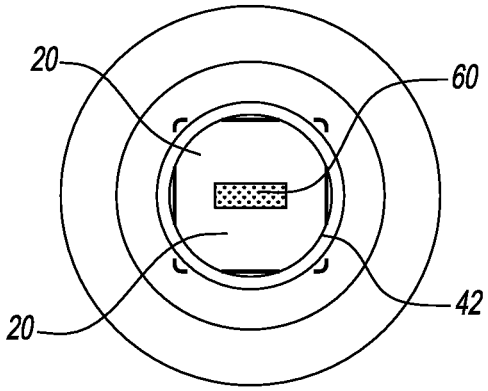
FIG. 6B is a top view of the embodiment of the present invention shown in FIG. 6A.

FIG. 6B is a top view of the embodiment of the present invention shown in FIG. 6A.

Figure 6C:
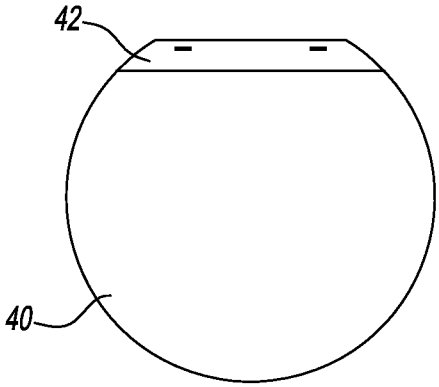
FIG. 6C is a side view of the embodiment of the present invention shown in FIG. 6A.

FIG. 6C is a side view of the embodiment of the present invention shown in FIG. 6A.

Figure 6D:
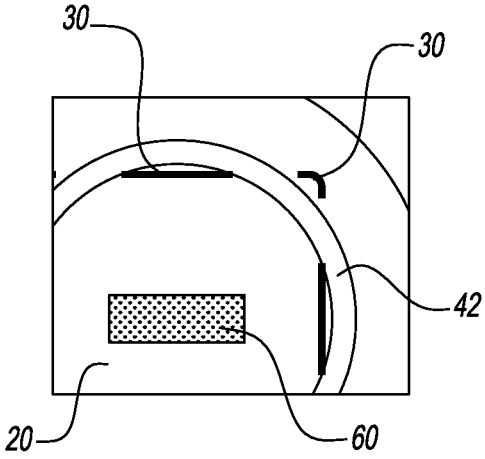
FIG. 6D is a close up, top view of the embodiment of the present invention shown in FIG. 6A.

FIG. 6D is a close up, top view of the embodiment of the present invention shown in FIG. 6A.

Figure 7A:
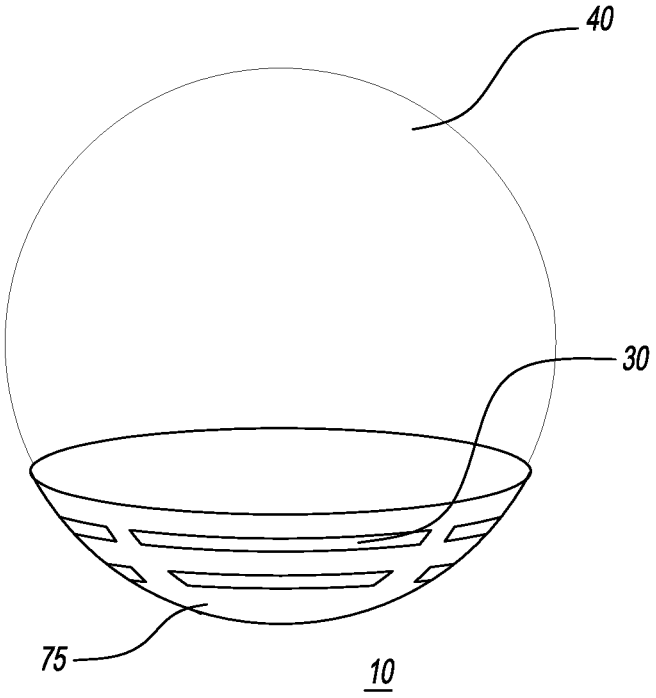
FIG. 7A is a perspective view of another embodiment of the present invention.

FIG. 7A is a perspective view of another embodiment of the present invention.

In this embodiment of the partially stabilized exercise device (10) there is no truncated end (42) of the sphere. Instead the elastic resistance members (30) may be attached to a cap (75). The cap (75) may in turn be secured to the substantially spherical ball (40) by means of a strap (80).

The strap (80) may, for instance, be made of an elastic material or it may be removably or permanently attached to the substantially spherical ball (40) by means of an adhesive such as, but not limited to, a glue or a hook and loop attachment or some combination thereof.

The cap (75) is preferably semi-rigid and made from a suitable plastic such as, but not limited to, an acrylic or polyurethane or some combination thereof. The cap (75) may also be deformable and made of a suitable fabric such as, but not limited to, a canvas, tarp material, a suitable cotton or a combination thereof.

Figure 7B:
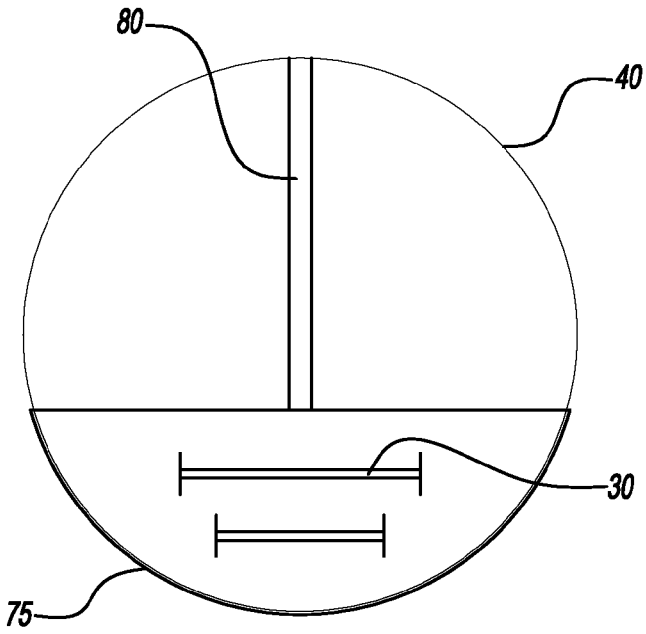
FIG. 7B is a side view of the embodiment of the present invention shown in FIG. 7A.

FIG. 7B is a side view of the embodiment of the partially stabilized exercise device (10) shown in FIG. 7A.

Figure 7C:
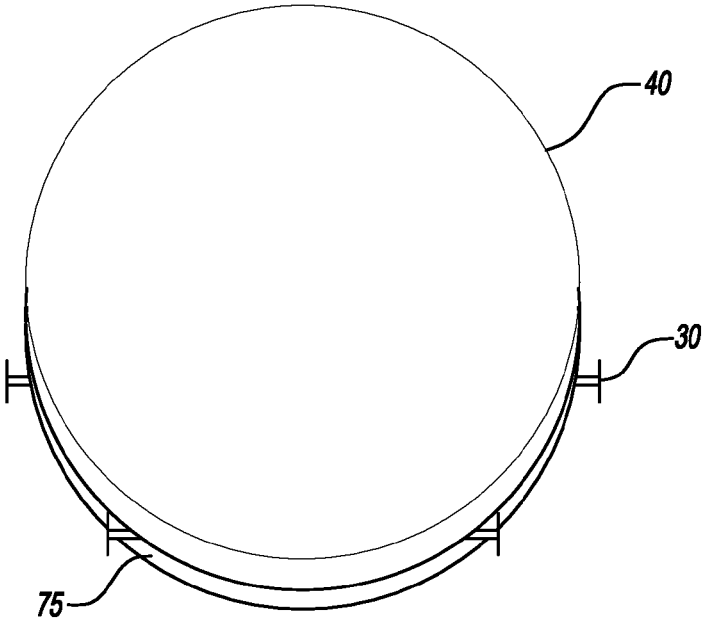
FIG. 7C is a top view of the embodiment of the present invention shown in FIG. 7A.

FIG. 7C is a top view of the embodiment of the partially stabilized exercise device (10) shown in FIG. 7A.

Figure 7D:
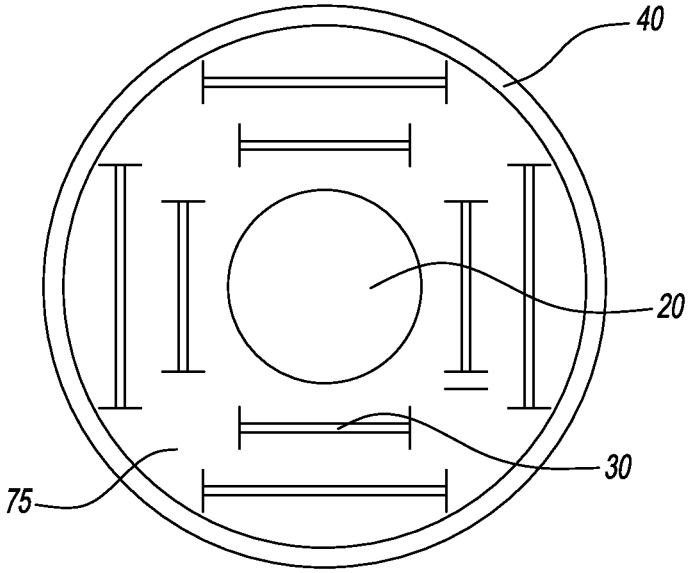
FIG. 7D is a bottom view of the embodiment of the present invention shown in FIG. 7A.

FIG. 7D is a bottom view of the embodiment of the partially stabilized exercise device (10) shown in FIG. 7A. In this view, the flat planar base insert (20) that may be attached to the cap (75) is shown more clearly.

Figure 7E:
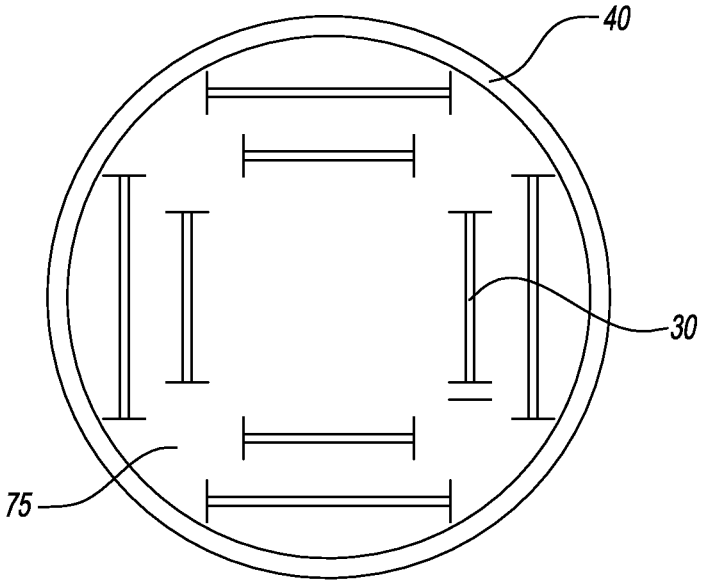
FIG. 7E is a bottom view of a variant of the embodiment of the present invention shown in FIG. 7A.

FIG. 7E is a bottom view of a variant of the embodiment of the present invention shown in FIG. 7A. In this embodiment of the partially stabilized exercise device (10), the cap (75) may have no flat planar base insert (20).

In summary, an exercise device (10) according to various aspects of the present invention incorporates a large, spherically-shaped, resilient ball (40) configured to support the weight of a user (50) having a flat planar base insert (20) comprising a set of elastic resistance members (30) to perform various resistance training exercises. The exercise device (10) facilitates effective strength training in addition to the development of flexibility, balance, coordination, and stability. The exercise device (10) is relatively inexpensive and simple to use, and it can be employed in a versatile manner to perform a number of different exercise movements.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

The present invention has been described with reference to preferred embodiments. However, those skilled in the art will recognize that changes and modifications may be made in the preferred embodiments without departing from the scope of the present invention. These and other changes and modifications that will be obvious to those skilled in the art are intended to be included within the scope of the present invention, as expressed in the following claims.

What is claimed:

1. A partially stabilized exercise device, comprising:

a truncated sphere having a diameter in a range of approximately 40 to 80 centimeters, constructed to be deformable within a range of 1 to 15 percent under the weight of an average sized adult human, and wherein a diameter of said truncation is in a range of approximately a quarter to a half of the diameter of said sphere;

a recess having four sides and a flat planar base insert located at the bottom of the recess within the truncated end of said truncated sphere;

at least one elastic resistance member located within said recess and attached to at least two sides of said recess of said truncated sphere at three or more spatially separated points, said elastic resistance member extending along the perimeter of said recess; and a coupling assembly having multiple points of connection disposed on an end of the at least one elastic resistance member and the perimeter of said recess, wherein the coupling assembly secures the at least one elastic resistance member to the perimeter of said recess.

2. The exercise device of claim 1, wherein the elastic resistance members are adjustable in position.

3. The exercise device of claim 1, wherein the elastic resistance members are adjustable in length.

4. The exercise device of claim 1, wherein the elastic resistance members are adjustable in resistance.

5. The exercise device of claim 1, wherein the elastic resistance members are formed from rubber strips or tubing.

6. The exercise device of claim 1, wherein the elastic resistance members are formed from polyurethane strips or tubing.

7. The exercise device of claim 1, wherein the elastic resistance members are removably attached to said truncated sphere.

8. The exercise device of claim 1, wherein the flat planar base insert has a diameter in the range of 10 to 40 cm.

9. The exercise device of claim 1 further including a strap attached to said flat planar base insert.

10. An exercise device comprising:

a large, spherically-shaped, resilient ball;

the large, spherically-shaped, resilient ball having a recess with four sides, the recess having a perimeter with a flat planar base insert at the bottom of the recess;

wherein the perimeter of the recess has at least one set of elastic resistance members detachably fastened thereto for pulling by the user to perform various resistance training exercises; and a coupling assembly, wherein the coupling assembly is disposed on an end of the at least one set of elastic resistance members and along the perimeter of the recess.

11. A partially stabilized exercise device comprising:

a large inflatable spherically shaped resilient ball;

detachable elastic resistance members;

a rectangular recess having four sides with a perimeter having a flat planar base insert at the bottom of the recess, wherein the four sides extend from the top of the recess to the bottom of the recess with the top of the recess having a larger diameter than a diameter of the bottom of the recess; and a coupling assembly having multiple points of connection for coupling the detachable elastic resistance members to the perimeter of the recess, wherein the coupling assembly is disposed along the perimeter of the recess and on at least one end of the detachable elastic resistance members.

* * * * *